US005125402A

United States Patent [19]

Greenough

[11] Patent Number: 5,125,402

[45] Date of Patent: Jun. 30, 1992

[54] POWERED RESPIRATORS

[75] Inventor: George K. Greenough, Sheffield, England

[73] Assignee: National Research Development Corporation, London, England

[21] Appl. No.: 539,325

[22] Filed: Jun. 14, 1990

Related U.S. Application Data

[63] Continuation of Ser. No. 395,217, Aug. 17, 1989, abandoned, which is a continuation of Ser. No. 930,573, Nov. 14, 1986, abandoned.

[30] Foreign Application Priority Data

Nov. 15, 1985 [GB] United Kingdom ..... 8528219
Nov. 15, 1985 [GB] United Kingdom ..... 8528222

[51] Int. Cl.[5] ..... A62B 7/10

[52] U.S. Cl. ..... 128/201.25; 128/201.28

[58] Field of Search ..... 128/201.25, 201.24, 128/201.23, 201.22, 201.28, 201.29, 207.12, 205.12; 137/527.6, 527

[56] References Cited

U.S. PATENT DOCUMENTS

| | | | |
|---|---|---|---|
| 2,940,471 | 6/1960 | Cupp | 137/527.6 |
| 3,822,698 | 7/1974 | Guy | 128/201.25 |
| 3,963,021 | 6/1976 | Bancroft | 128/201.25 |
| 4,280,491 | 7/1981 | Berg et al. | 128/201.25 |
| 4,350,507 | 9/1982 | Greenough et al. | 128/201.25 |

FOREIGN PATENT DOCUMENTS

| | | | |
|---|---|---|---|
| 0199449 | 10/1986 | European Pat. Off. | 128/201.25 |
| 1055969 | 4/1959 | Fed. Rep. of Germany . | |
| 1213249 | 3/1966 | Fed. Rep. of Germany . | |
| 2744488 | 6/1978 | Fed. Rep. of Germany | 128/201.25 |
| 463453 | 4/1975 | U.S.S.R. | 128/201.25 |
| 225454 | 12/1924 | United Kingdom . | |
| 676131 | 7/1952 | United Kingdom . | |
| 930692 | 7/1963 | United Kingdom . | |
| 1218285 | 1/1971 | United Kingdom . | |
| 1376714 | 12/1974 | United Kingdom . | |
| 1426432 | 2/1976 | United Kingdom . | |
| 1495020 | 12/1977 | United Kingdom | 128/201.25 |
| 1518192 | 7/1978 | United Kingdom . | |
| 2032284 | 5/1980 | United Kingdom | 128/201.25 |
| 1574311 | 9/1980 | United Kingdom . | |
| 2061696A | 5/1981 | United Kingdom . | |
| 2063074 | 6/1981 | United Kingdom | 128/201.25 |

*Primary Examiner*—Kyle L. Howell
*Assistant Examiner*—J. P. Lacyk
*Attorney, Agent, or Firm*—Cushman, Darby & Cushman

[57] ABSTRACT

A powered respirator of self-contained form for use in oxygen-sufficient atmospheres comprises a visored helmet (10) defining in use a passageway (15) extending from a rear opening (16) across the user's head (13) and face, an electric fan (17) and filter (19) located adjacent the opening to pass respiration air through the passageway, a fan battery (18) housed forwardly of the helmet, and an exhaust valve (20) mounted in the passageway near the user's mouth, the valve operating to open in response to gas pressure similar to that of normal exhalation and including a spring closure mechanism having a decreasing spring rate during opening.

3 Claims, 1 Drawing Sheet

POWERED RESPIRATORS

Figure 1:
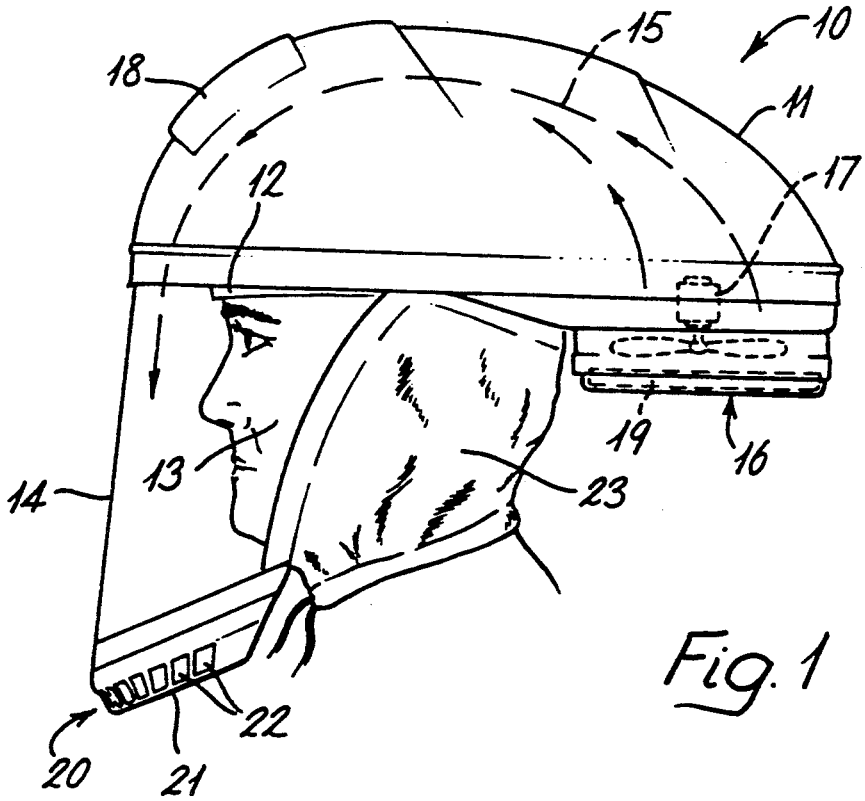

This is a continuation of application Ser. No. 07/395,217, filed Aug. 17, 1989, now abandoned, which is a continuation of Ser. No. 06/930,573, filed Nov. 14, 1986, now abandoned.

This invention concerns powered respirators and more particularly such respirators of a form suitable for use by individuals working in environmental atmospheres which are dusty or otherwise contaminated, but which are nevertheless sufficient in oxygen content for normal human activity rather than oxygen-deficient.

Respirators of this form are already available in accordance with British Patent Nos. 1426432 and 1495020. However these available respirators have themselves, for practical purposes, been of a particular form relative to the greater range of possibilities suggested within the related patents. This form has involved a visored helmet defining in use a passageway therethrough across the user's head and face, the helmet housing an electric fan at its rear to draw air from the ambient atmosphere and to pass the same through the passageway by way of a bag filter therein above the user's head. In the result the user breathes filtered air, contamination from the other end of the passageway relative to the fan and filter being avoided or reduced to an acceptable level by air outflow. A particular benefit of this form of respirator arises from the specific use of a bag filter whereby the effective filter surface area is significantly increased relative to other filter configurations compatible with the available space, and the power requirement for the fan is consequently reduced to the extent that a bodily-portable battery power source can be adequate for a conventional working shift of the order of 8 hours, say, without need for battery change or recharging. Even so a battery for this purpose is commonly of such weight as to be carried separately by way of a belt and be connected to the helmet by a lead rather than be mounted directly on the helmet. While this does not appear superficially to represent a particularly onerous complexity, the reality is that it is a practical disincentive for the use of respirators in a variety of industrial situations. This is but one example of the general observation that, in circumstances where protective measures are desirable from a health or safety point of view but are not seen to be so in a compelling manner by the workforce, workers will not readily adopt those measures unless there is a minimal, and therefore acceptable, inconvenience to the individuals in question and disturbance to their established working practices.

Against this background, an object of the present invention is to provide a more generally acceptable industrial respirator relative to those currently available.

To this end there is provided a powered respirator of self-contained form for use in oxygen-sufficient atmospheres, comprising:

a visored helmet defining in use a passageway therethrough extending across the user's head and face from a rear opening;

an electric fan located in said passageway to draw ambient air through said opening and to pass such air across the user's face for respiration;

a filter positioned across said passageway upstream thereof relative to said visor;

a battery power source housed in said helmet for said fan; and a unidirectional valve mounted in said helmet adjacent the user's respiratory orifices to exhaust exhaled gas from said passageway, said valve being operable to open in response to gas pressure similar to that of normal exhalation, and including a spring mechanism operable normally to close the valve, such mechanism exhibiting a decreasing spring rate during valve opening.

The benefit of this respirator relative to comparable currently-available forms lies in its self-contained nature by accommodation of the fan power supply in the helmet itself and this simplification will reduce the reluctance effective against use. This self-containment arises, in turn, from the use of an overall respirator configuration which is structurally closed against contaminated air, with exhaled gas being vented by way of the valve, whereby a reduced air flow rate is viable compared to that appropriate for the prior respirator form referred to above, the fan power requirement is accordingly reduced, and so also is battery weight to allow helmet mounting.

Given a reduced air flow rate, it is important that exhaled gas be exhausted efficienty without accumulation and the proposed valve form and its siting is appropriate to this end. The valve will have a low resistance operating characteristic and act rapidly in response to gas pressure variations similar to those in normal respiration.

The helmet will normally have a hat portion with the visor depending therefrom at the front. The hat portion can be of a single skin form to define part of the passageway in association with the user's head, or the hat portion can be of a double skin form to define the corresponding passageway part, with the inner skin in the latter case possibly being of a separable fabric form for purposes of cleaning. In either case at least part of the helmet is to be substantially sealed to the user to close the passageway except for the rear opening and the valve. This is preferably effected by the provision of a flexible curtain depending from the helmet and comformable at its free periphery with the user's neck. Such a mode of closure is convenient and comfortable for the user, and is viable without effecting absolute sealing provided that gas exhaustion is predominantly by way of the valve. Closure by elastication or a draw cord about the neck is satisfactory for this purpose.

The fan is preferably accommodated in the passageway adjacent its opening, with the helmet being of a rearwardly extended shape relative to a user's head for this purpose whereby the helmet is not of undue height. At the same time a battery housing is preferably provided towards the front of the helmet, above a user's forehead, to result in a balanced arrangement in terms of weight distribution.

A filter, such as of pad form, sited across the passageway opening to act as a pre-filter relative to the fan is found adequate for many industrial purposes and is beneficial in reducing dust deposition within the fan unit. However an alternative or additional filter site can be downstream of the fan in the passageway and such a site can accommodate a bag filter.

While reference has been made to a helmet it is not to be assumed that the presently proposed respirator affords impact protection although the helmet can, of course, be of "hard hat" form.

The helmet will in practice normally carry a switch to allow energisation of the fan when the respirator is donned for use. Also it may be desirable for some purposes to provide an indication of pressure variations within the helmet. Such variations will correlate with the inhalation and exhalation phases of the user's respiration which correlate, in turn, with closure and opening of the valve and so the desired indication can be generated in response to the valve member movement suitably, for example, by arranging for this member to repetitively interrupt the optical path between an LED or other light source and a photodiode or other such detector to pulse an indicator light.

A fuller understanding of the present invention is afforded by the following description of a preferred form given by way of example and illustrated by the accompanying drawings, in which:

FIG. 1 schematically illustrates the preferred respirator in side view, and

Figure 2:
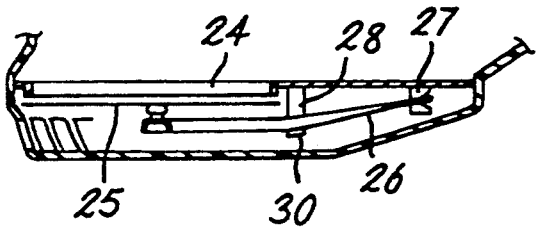
Figure 3:
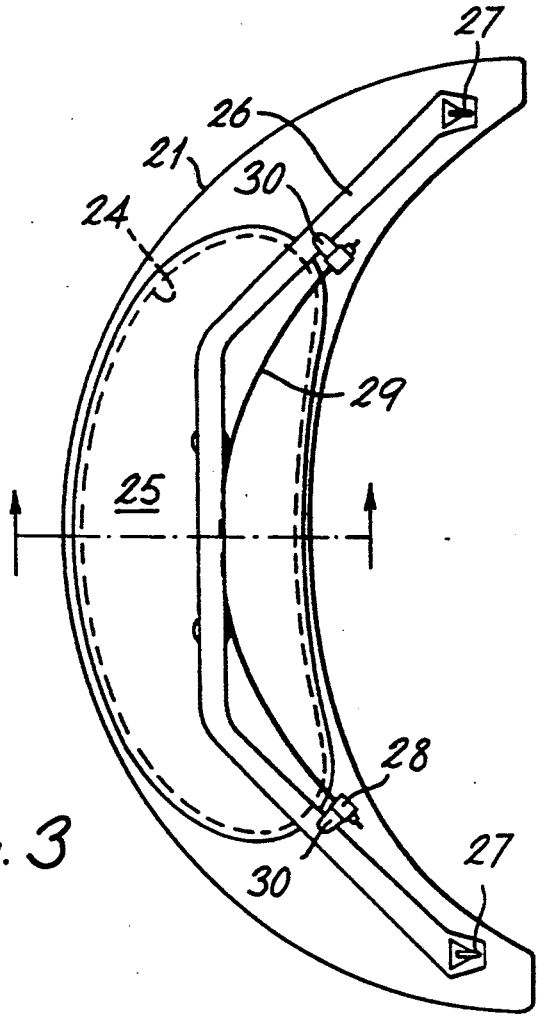

FIGS. 2 and 3 diagrammatically illustrate detail of the exhalation valve of such respirator respectively in cross-sectional (on line 2—2 in FIG. 3) and underneath views.

The respirator of FIG. 1 comprises a helmet 10 including a hat part in the form of a domed shell 11 incorporating a harness 12 for engagement with a user's head 13 and having a visor 14 depending from the front of its rim to extend over and round the user's face. The shell is spaced above the harness, and projects forwardly and rearwardly of the harness, to define a passageway 15 which, in use, extends from a rear opening 16 across the head and then downwardly over the face behind the visor.

An electric fan 17 is located in the passageway adjacent its rear opening to draw ambient air into the opening to flow through the passageway. The shell is provided with a battery housing 18 to power the fan and a pad filter 19 is fitted across the passageway rear opening.

It is to be noted that the helmet shell projects significantly to the rear of the harness so that the fan is sited behind the head: this allows the shell to be of modest height which is beneficial because tests indicate increase of height may be more significant in terms of discomfort or obstruction to the user than rearward projection. Also, the rearward projection of the shell allows the opening and its filter to face downwardly so that the filter is protected from falling contaminants and other damage. At the same time the battery housing is located forwardly of the shell over the user's forehead to balance the helmet from the point of view of weight distribution.

An exhalation valve assembly 20 is connected to the lower periphery of the visor, detail of the valve mechanism being described below with reference to FIGS. 2 and 3. This assembly involves a hollow chamber 21 which extends across the lower visor periphery adjacent the chin of a user, the front wall of this chamber having a series of vent apertures 22 across its width, and the body of the chamber projecting rearwardly towards the user's chin.

Lastly in the overall form of the respirator, a flexible neck curtain 23 is sealingly connected with the rear of the valve chamber, the sides of the visor, and the rear of the helmet shell rim. This curtain is elasticated or provided with a draw cord at its free periphery to conformingly seat around the user's neck in substantially sealing manner and so effectively close the helmet passageway remotely of its rear opening, apart from the operation of the valve assembly 20.

Turning to the detail of the valve assembly shown in FIGS. 2 and 3: the chamber 21 is seen to be of overall crescent shape in plan. The roof of the chamber has a major centrally located area apertured to a kidney shape to define a valve port 24. Below the roof is a valve member 25 in the form of a plate of similar shape to the port, but slightly larger size. The valve member is loosely attached above an elongate carrier 26 extending longitudinally of the member and projecting beyond its ends, the carrier ends being angled relative to its center and pivotally coupled to respective posts 27 depending from the chamber roof. Two further posts 28 similarly depend from the roof respectively between each first-mentioned post 27 and the associated end of the valve port and member. The further posts carry respective ends of a spring wire 29 extending arcuately in a plane therebetween to engage the carrier. Also each of the further posts has at its free end a transverse projection 30 extending below the carrier to limit movement of the latter and the valve member away from the port. The elements of the valve form a symmetrical assembly which in use generally follows the transverse profile of the user's chin.

The arrangement of the spring wire is such as to apply a force to the carrier and valve member urging the latter towards the chamber roof, and the member is positioned normally to seat on the roof and to close the valve port. However, the more particular arrangement of the spring wire is that it is mounted in a transversely off-set manner from the valve member as also is the carrier, and the pivotal nature of the valve member/carrier movement relative to the port is such as to reduce the effective distance from the carrier mounting at which the wire acts on the member. Accordingly, although the spring force may increase with valve opening, the spring rate effective on the valve member decreases. This affords a more rapid valve opening than would otherwise normally occur with a mechanism having a constant or increasing spring rate.

The operation of the valve, in relation to use of the respirator to supply filtered air continuously to the user for respiration, is to be such that the valve closes during inhalation and opens during exhalation. The valve is, of course, located adjacent to the breathing zone of the respirator around the user's respiratory orifices and the pressure in this zone will decrease and increase as the user inhales and exhales during respiration.

Given that inhalation and exhalation pressures are of a similar level during normal respiration, these considerations indicate the air supply capability which is appropriate for the fan. Thus, the fan should supply air to the breathing zone at a pressure level at least similar to that of inhalation in order to be adequate, but not so high as to open the valve during inhalation. In the result the valve opens rapidly to exhaust exhaled gas in response to the summed effect of exhalation pressure and the supply from the fan, while the fan supply is significantly reduced relative to the case where sealing against contamination relies on outflow of air supply from the fan throughout the respiration cycle.

In fact, minimum air supply requirements for the purposes of respiration with helmets of a kind such as those discussed above are already officially laid down by statutory or equivalent regulations in many territories, such a requirement typically being of the order of 120 liters/minute. At the same time yet other official requirements can need to be met by respirator helmets in connection with factors such as carbon dioxide levels and contamination by dust or other undesirable matter within the helmet. These requirements coact in such a way that respirator helmets operate to provide what is commonly termed a protection factor, with different protection factors being relevant to different environmental conditions.

In any event, it is appropriate for the present helmet to meet official requirements in respect of air supply rate for respiration purposes, but it is not necessary for this rate to be exceeded to any significant degree in order to ensure effective sealing and/or a satisfactory exhaustion of exhaled gas. In the result, the energy requirement for use through a working shift of the order of 8 hours can be met by way of a battery supply of weight suited to helmet mounting.

In connection with the foregoing, it is known that the pressures which occur in the innermost spaces of the lungs during normal breathing fluctuate about ±1 cm $H_2O$ (±0.1 kPa) around atmospheric pressure. Hence, the pressure at the mouth and/or nose during exhalation will be at a lower level within this range.

I claim:

1. A powered respirator of self-contained form for use in oxygen-sufficient atmospheres comprising:

a helmet having opposed front and rear ends for respective location at the front and rear of a user's head, having a visor depending from said front end and curving transversely for location over and to cover a user's face, having an opening at said rear end, and having walls to define a passageway extending from said rear opening to said visor across a user's head and face, one of said walls extending from the lower periphery of said visor for location around and beneath a user's chin;

closure means extending wholly around the periphery of said helmet and operable substantially to engage a user in effective sealing relation;

an electric fan located in said passageway to draw ambient air through said opening and to pass such air through said passageway for user respirator;

a filter positioned across said passageway upstream thereof relative to said visor;

a battery power source housed in said helmet for said fan;

a valve port defined by an aperture in said one wall, said aperture being wholly bounded by a marginal edge portion of said one wall;

a valve member of plate form located outside said passageway adjacent said valve port;

an elongate carrier pivotally interconnecting said valve member to said one wall at a location on the latter transversely offset from said port, and movable between two positions in which said valve member is respectively seated on and disengaged from said marginal edge portion of said one wall surrounding said aperture to close and open said port, said carrier having a central portion extending below said valve member and relatively angled end portions pivotally suspended below said one wall; and a bowed spring of wire form extending and acting between said valve member and one wall at a location on the latter transversely offset from said port in a similar direction to that for said carrier, said spring having a central portion extending below said valve member and end portions pivotally suspended below said wall, said spring acting normally to seat said valve member on said marginal edge portion to close said port, and said spring exerting a force at such port closure which is similar to that applied to the area of said valve member by air pressure of the order of normal exhalation.

2. A respirator according to claim 1 wherein said port and valve member are of similar kidney shape, and said one wall, port, valve member, carrier and wire form a symmetrical assembly generally following the transverse profile of the user's chin.

3. A respirator according to claim 1 wherein said closure means comprises a flexible curtain depending from said helmet and having a free peripheral portion, said curtain being comfortable at its free peripheral portion with the user's neck substantially to close said passageway except at said opening and said valve.

* * * * *